US005537904A

United States Patent [19]

Albin

[11] Patent Number: 5,537,904

[45] Date of Patent: Jul. 23, 1996

[54] REVERSIBLE MAT CUTTER

[76] Inventor: Stephen D. Albin, 610 Rancho, Los Altos, Calif. 94024

[21] Appl. No.: 289,183

[22] Filed: Aug. 11, 1994

[51] Int. Cl.[6] ..... B26D 1/04

[52] U.S. Cl. ..... 83/455; 83/564; 83/578; 83/581; 83/614

[58] Field of Search ..... 83/614, 455, 578, 83/581, 635, 564

[56] References Cited

U.S. PATENT DOCUMENTS

| | | | |
|---|---|---|---|
| 3,463,041 | 8/1969 | Shapiro | 83/564 |
| 3,527,131 | 9/1970 | Ellerin et al. | 83/522 |
| 3,768,357 | 10/1973 | McBride | 83/438 |
| 3,774,495 | 11/1973 | Matthew | 83/581 |
| 3,779,119 | 12/1973 | Broides | 83/614 |
| 3,871,079 | 3/1975 | Magee | 30/294 |
| 3,897,706 | 8/1975 | Martin | 83/455 |
| 3,918,337 | 11/1975 | Lindblad et al. | 83/614 |
| 3,967,519 | 7/1976 | Esterly | 83/455 |
| 3,973,459 | 8/1976 | Stowe | 83/455 |
| 4,022,095 | 5/1977 | Jones | 83/455 |
| 4,038,751 | 8/1977 | Albright | 30/293 |
| 4,045,266 | 8/1977 | Hewitt, Jr. | 156/91 |
| 4,096,631 | 6/1978 | Ward | 30/294 |
| 4,158,977 | 6/1979 | Logan | 83/522 |
| 4,249,437 | 2/1981 | Hagenson | 83/39 |
| 4,413,542 | 11/1983 | Rempel | 83/614 |
| 4,440,055 | 4/1984 | Gelfand | 83/529 |
| 4,505,174 | 3/1985 | Carithers, Jr. | 83/455 |
| 4,506,576 | 3/1985 | Crawford et al. | 83/455 |
| 4,545,515 | 10/1985 | Kozyrski | 225/96.5 |
| 4,570,516 | 2/1986 | Bruns | 83/455 |
| 4,590,834 | 5/1986 | Sobel | 83/455 |
| 4,631,997 | 12/1986 | Sobel | 83/29 |
| 4,641,556 | 2/1987 | Vigneron et al. | 83/36 |
| 4,651,607 | 3/1987 | Camp | 83/467 R |
| 4,662,258 | 5/1987 | Mood | 83/455 |
| 4,798,112 | 1/1989 | Kozyrski et al. | 83/455 |
| 4,798,118 | 1/1989 | Carithers, Jr. | 83/875 |
| 4,858,507 | 8/1989 | Evans et al. | 83/455 |
| 4,867,023 | 9/1989 | Kozyrski et al. | 83/455 |
| 4,878,409 | 11/1989 | Carithers, Jr. | 83/466 |
| 4,881,439 | 11/1989 | Biederman et al. | 83/879 |
| 4,936,020 | 6/1990 | Neblett | 33/566 |
| 4,936,176 | 6/1990 | Silverman | 83/468 |
| 5,161,445 | 11/1992 | Kozyrski et al. | 83/614 |
| 5,269,212 | 12/1993 | Peters et al. | 83/614 |
| 5,322,001 | 6/1994 | Boda | 83/614 |

*Primary Examiner*—Kenneth E. Peterson
*Attorney, Agent, or Firm*—Hickman Beyer & Weaver

[57] ABSTRACT

A reversible mat cutter for cutting openings in oversized picture frame mats is disclosed. In one aspect of the invention, the guide rod and mat bar are easily detachable from the clamping frame of the mat cutter. Once detached, the cutter head assembly is then easily removed, reversed and remounted on the guide rod such that the cutter head then cuts on the opposite side of the guide rod. Both the mat guide and squaring arm are both quickly and easily detached from one side of the guide bar and remountable on the other side so that then an oversized picture mat may then be lain flat on the mat cutter and cut with the reversed cutter head.

15 Claims, 6 Drawing Sheets

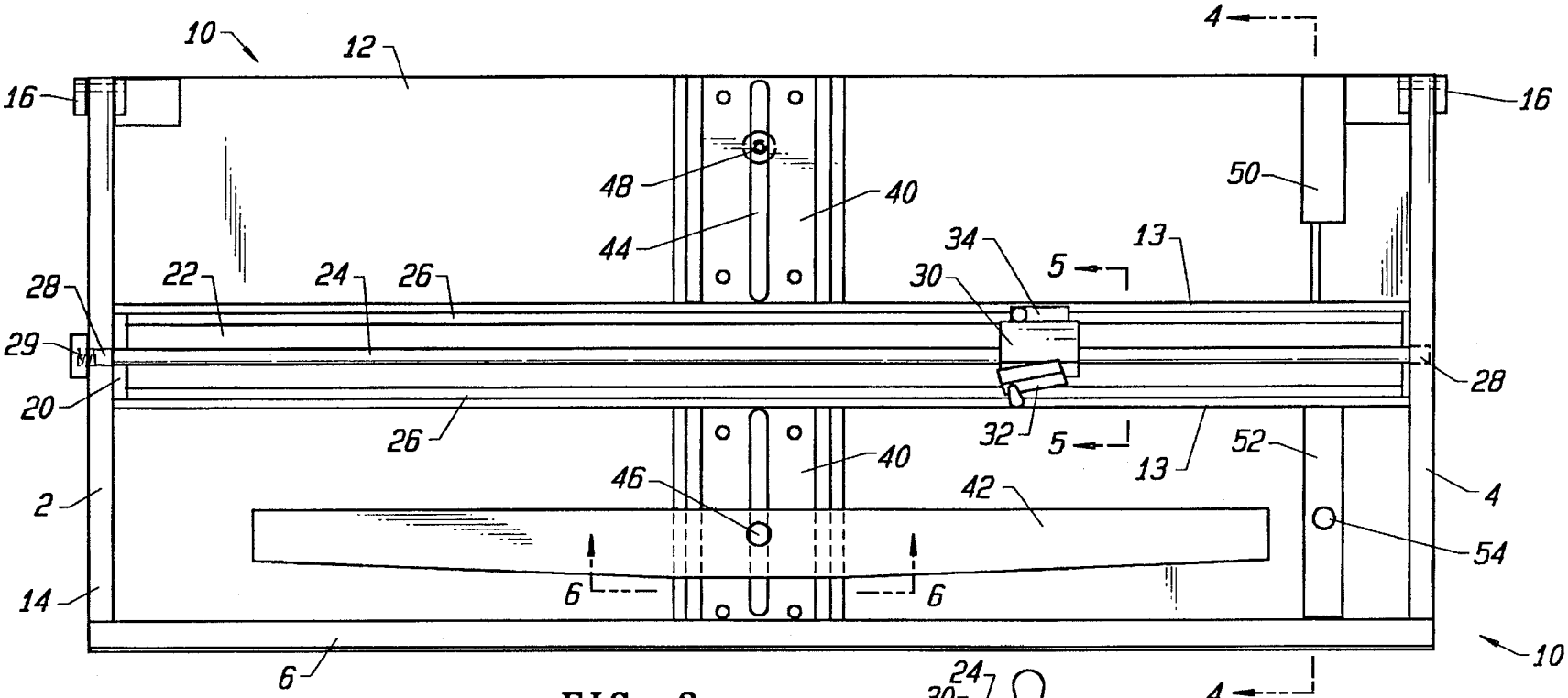
FIG. 3
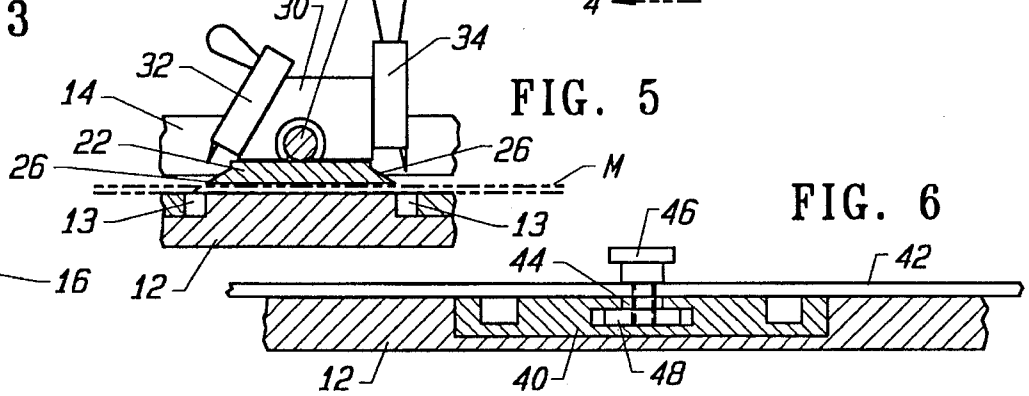
FIG. 5
FIG. 6
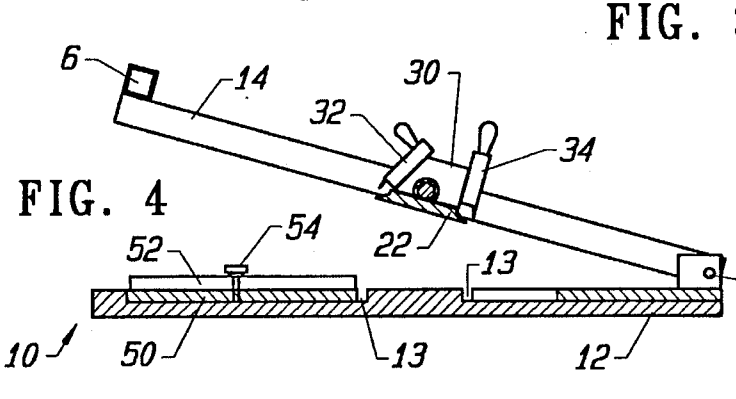
FIG. 4

REVERSIBLE MAT CUTTER

BACKGROUND OF THE INVENTION

The present invention relates generally to a mat cutter for cutting openings in picture mats used to frame pictures. More specifically, the present invention relates to a reversible mat cutter suitable for cutting oversized mats.

Picture mats are formed of a heavy card stock. A mat cutter has a cutter head mounted on a hinged frame which cuts internal openings in a picture mat within which a picture is framed. Typically, the cutter head is mounted on a rod supported by the hinged frame. The rod serves to guide the cutter head across the picture mat to be cut. Since, in the usual case, the opening for the framed picture will be defined by beveled edges, the cutter heads have often been provided with two blades, one blade to cut through the picture mat vertically, at a 90 degree angle, and another blade to cut at an acute angle (typically about 55 degrees) to produce a beveled opening. Picture mats are typically cut from the back, the blade being angled such that the border of the picture mat is located on the side of the guide rod opposite where the hinged frame is attached.

In most of the prior art, the angled blade is positioned on the side of the guiding rod away from the edge of the base where the hinged frame is attached. Thus, the picture mat is inserted from the edge where the hinged frame is attached and between the hinges. Therefore, a picture mat larger than the distance between the hinges cannot be cut. Furthermore, many prior art mat cutters utilize a guide rod mounted on a flat mat bar. This mat bar has one beveled edge to guide the angled blade, and one straight edge for the vertical blade.

FIG. 1 is a representative example of a prior art mat cutter 110. A hinged frame 114 attaches to the base 112 at a pair of hinges 116. The frame carries a mat bar 122, upon the top surface is mounted a guide bar 124. Both the mat bar 122 and the guide bar 124 are securely fastened to the tame 114. A cutter head 130 slides along the guide bar 124. A squaring arm 152 is mounted on the base 112, and a mat guide 142l is attached to the squaring arm 152. The cutter head 130 has an angled blade 132 for cutting a beveled edge, and a straight blade 134. The mat bar has a tapered edge 126 for guiding the angled blade, and a straight edge 127 for guiding the straight blade.

U.S. Pat. No. 3,996,827 (Logan) discloses a mat cutter in which the angled blade is mounted on the guide rod on the side away from the hinge attachment. The cutter head is not designed to be removable nor is the guide rod able to be easily detachable from the hinged frame. In U.S. Pat. No. 4,413,542 (Rempel) the mat cutter disclosed also shows an angled blade mounted on a fixed guide rod on the side away from the hinges. The mat guide for positioning a mat is only mountable on this side as well. The squaring arm is also only mountable on one side of the guide rod and is not quickly and easily detachable. U.S. Pat. Nos. 4,747,330 (Carithers, Jr.) and 4,871,156 (Kozyrski et al.) both disclose similar arrangements in which a mat cutter is designed to only receive a picture mat from one side.

The disadvantage of the prior art is that although a normal size picture mat can be inserted between the hinges to have an opening cut in its interior with beveled edges, an oversized picture mat (whose length is greater than the distance between the hinges) will not fit. Nor can an oversized picture mat be inserted from the side opposite the hinges because then the angled blade (which is fixed on one side) will cut a reverse bevel. Also, a problem is encountered if an oversized picture mat is inserted from the side opposite the hinges because the distance between a blade and the hinges is typically around four inches. Thus, a border of only four inches can be cut and an oversized mat often requires a larger border.

U.S. Pat. No. 3,213,736 (Keeton) discloses a mat cutter in which the angled blade is positioned on the same side of the guide rod as the hinges. However, neither the guide rod nor the mat bar is easily detachable from the hinged frame. The cutter head is also not reversible so that the angled blade could cut on the other side of the guide rod. The mat cutter in Keeton also has a relatively small distance between the angled blade and the mat guide or the hinges, allowing only a smaller border to be cut for a picture mat.

Considering the above disadvantages of the prior mat cutters, a reversible mat cutter that is well suited for cutting oversized mats would be desirable.

SUMMARY OF THE INVENTION

To achieve the foregoing and other objects and in accordance with the purpose of the present invention, a reversible mat cutter for the cutting of oversized picture mats is disclosed. A substantially flat base is used to support a picture mat to be cut and to support a clamp frame that is pivotally attached to the base at one edge of the base. A linear guide assembly which serves to press the picture mat toward the base stretches longitudinally across the base and is attached at either end to the clamp frame. The guide assembly also guides the cutter head as it cuts the picture mat on a first side of the guide assembly.

The guide assembly is attached to the clamp frame in a manner that allows one end of the guide assembly to be quickly and easily removed from the clamp frame. Once free, the cutter head can be removed from the guide assembly, reversed and slid back onto the guide assembly so that the angled blade cuts on a second side of the guide assembly.

In one embodiment the guide assembly includes two parts, a flat-bottomed mat bar and a cutter head guide rod. The flat-bottomed mat bar presses the picture mat toward the base, and the cutter head guide rod is mounted on top of the mat bar. The cutter head slides along the guide rod as it cuts the picture mat. The cutter head may have only an angled blade on the first side, or it may have the angled blade and also a straight blade on the second side of the mat bar. Each edge of the mat bar is tapered in a latitudinal direction so as to guide the angled blade as it cuts a bevel in a picture mat. The base may have a cutting groove extending longitudinally on each side of the mat bar directly below a cutting blade. As the blade cuts through the picture mat the tip of the blade extends into the cutting groove so as to not contact the surface of the base.

In another embodiment a mat guide that is attachable on either side of the mat bar is provided to help position the picture mat. The mat guide runs longitudinally along the base and is adjustable to vary the distance between the edge of the mat guide and a cutting blade. In this manner, a border width for a picture mat can be varied. A mat guide mount is located on each side of the mat bar so that the mat guide can be mounted on either side. The mat guide mount may be recessed so that when the mat guide is removed a picture mat may lie flat on the base.

In another embodiment a squaring arm is also mounted on the base. The squaring arm runs latitudinally and is perpendicular to the mat guide. It can be mounted on either side of the mat bar. The squaring arm serves to help square the picture mat. Like the mat guide, the squaring arm is also quickly and easily detachable from the base.

In one arrangement of the mat cutter that is particularly well suited for cutting an oversized picture mat, the cutter head is reversed so that the angled blade cuts on the second side of the mat bar adjacent to the edge where the clamp frame is pivotally attached. The mat guide is mounted on this second side as well, and if a squaring arm is to be used, it too is mounted on this second side. The distance between the mat bar and the pivotal attachment is extended relative to standard mat cutters so a larger border can be cut on an oversized mat. The mat cutter is designed so that the base on the first side of the mat bar is a flush surface, and an oversized picture mat may lie flat upon the base.

In one embodiment the cutter head may be reversed by releasing one end of the mat bar from the clamp frame. The cutter head can then be slid off of the cutter head guide rod, reversed and slid back on to the guide rod. Next, the mat bar is reattached to the clamp frame. Thus, the cutter head can cut on the second side of the mat bar. The mat guide and squaring arm can also be quickly removed from the first side of the mat bar so that an oversized picture mat can lie flat.

BRIEF DESCRIPTION OF THE DRAWINGS

The invention, together with further objects and advantages thereof, may best be understood by reference to the following description taken in conjunction with the accompanying drawings in which:

FIG. 3 is a top view of the mat cutter shown in FIG. 2.

FIG. 4 is an end view of the mat cutter shown in FIG. 3.

FIG. 5 is a fragmentary end view of the cutter head of FIG. 3.

FIG. 6 is a fragmentary frontal view of a portion of the mat guide of FIG. 3.

DETAILED DESCRIPTION OF THE INVENTION

Figure 1:
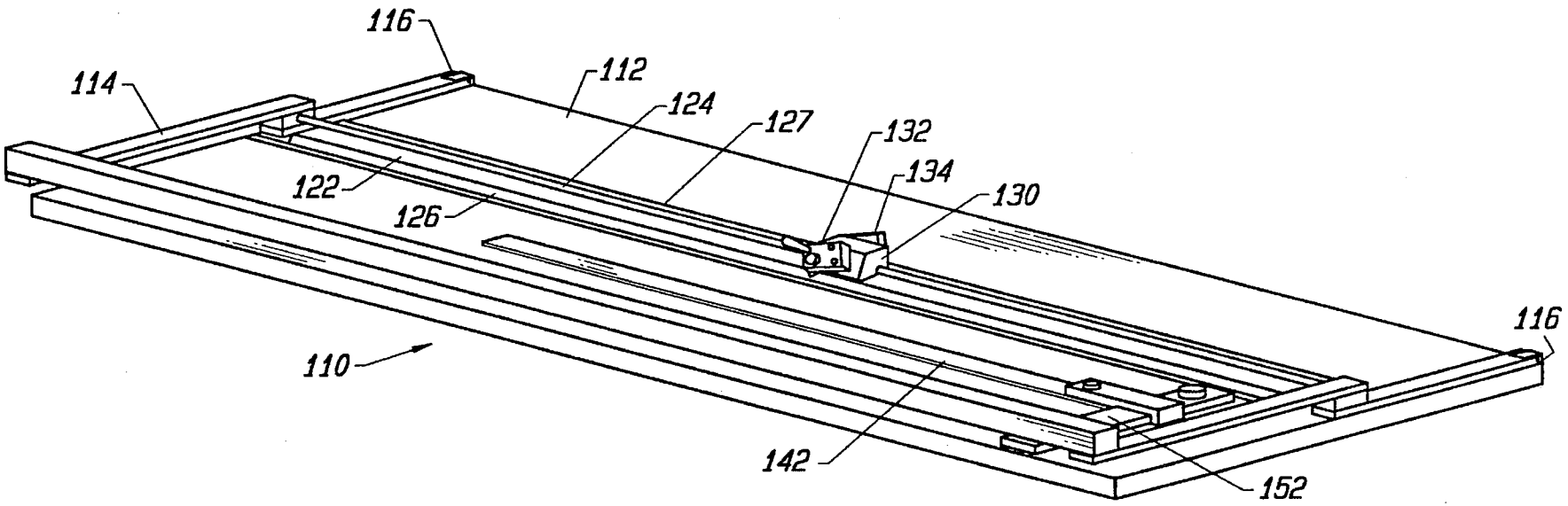
FIG. 1 (PRIOR ART)
FIG. 1 is a perspective view of a prior art mat cutter.
Figure 2:
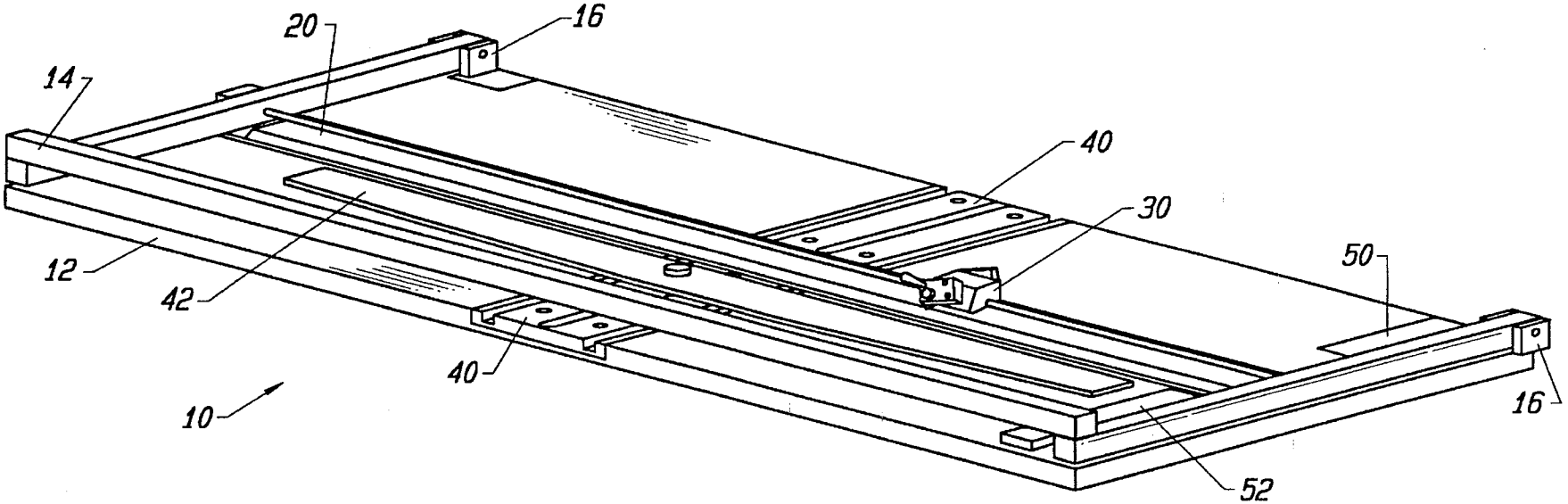
FIG. 2 is a perspective view of a mat cutter in accordance with the present invention.

Turning to the FIGS. 2–9 of the appended drawings, a reversible mat cutter embodying the present invention will be discussed. FIG. 2 shows in general a reversible mat cutter 10 in a traditional arrangement. A base 12 is provided to support a picture mat. A clamp frame 14 is attached to the base 12 at pivots 16. The pivots 16 may take the form of hinges or any other conventional hinging mechanism. The clamp frame 14 is shown in its cutting position, but it can also be pivoted upward around pivots 16 to a raised position to receive a picture mat.

The clamp frame 14 carries a guide assembly 20. A cutter head 30 slides along the guide assembly 20 to facilitate the cutting of a picture mat. Mat guide mounts 40 which serve to position a mat guide 42 are recessed on either side of the guide assembly 20. Squaring arm mounts 50 which serve to secure a squaring arm 52 are also recessed on either side of the guide assembly 20.

Turning next to FIG. 3, a more detailed top view of the described embodiment is shown. The mat cutter 10 is shown having a base 12 with the clamp frame 14 lowered into the cutting position. The actual size of the base may vary widely with the needs of particular mat cutters. By way of example, a base having dimensions of approximately forty-eight inches by twenty inches works well for use in many typical frame shops. The clamp frame 14 consists of two arms 2 and 4 joined by a handle 6. The two arms 2 and 4 extend from the pivots 16 along opposite edges of the base 12 and are joined by the handle 6. The handle 6 mounts on the top at the end of each arm to allow space in which to grasp the handle for raising the entire clamp frame 14.

The guide assembly 20 includes a mat bar 22 and a cutter head guide rod 24. The mat bar 22 has the cutter head guide rod 24 mounted on its top surface. The cutter head 30 is slidably mounted on the guide rod. The mat bar has two tapered edges 26 which serve to guide the cutting blades on the cutter head 30 when a mat is being cut. The mat bar also has a broad flat-bottomed surface for pressing a mat against the base during cutting. The guide assembly 20 is carried by the clamp frame 14 by inserting each end of the cutter head guide rod 24 into circular openings 28 in the arms 2 and 4. The circular opening 28 in arm 2 contains a spring 29 which firmly holds the cutter head guide rod 24 in place and also allows the quick and easy removal of the guide assembly 20 from the clamp frame 14.

As best shown in FIG. 3, the cutter head 30 has two cutting blades mounted thereon. These include an angled blade 32 and a straight blade 34. When cutting a picture mat, either blade will extend through the picture mat into one of the cutting grooves 13 in the base 12.

The mat guide 42 can be mounted on either mat guide mount 40. Each mat guide mount 40 has a slot 44. A bolt 46 goes through the mat guide 42 and into the slot 44 where it screws into a large nut 48 in order to hold the mat guide 42 in position. The large nut 48 is positionable within the slot 44 in order to adjust the distance from the mat guide 42 to the guide assembly 20. The squaring arm 52 is secured to either squaring arm mount 50 with a bolt 54.

FIG. 4 is a side view of the reversible mat cutter with the clamp frame 14 shown in the raised position. In this position a picture mat may be easily placed on the base 12 for cutting. When lowered, the mat bar 22 will press a picture mat towards the base 12. In the lowered position, the mat bar 22 is supported by an island formed in the base 12 by cutting grooves 13. Also shown in particular is the bolt 54 which secures the squaring arm 52 to the squaring arm mount 50. The bolt 54 has a large head which makes it quickly and easily detachable by hand. The handle 6 of the clamp frame 14 is also shown mounted on the top at the end of each arm 2 and 4.

FIG. 5 shows in detail a side view where the clamp frame 14 is lowered into the cutting position. The cutter head 30 is mounted on the cutter head guide rod 24, and the mat bar 22 presses a picture mat M to the base 12. The tapered edges 26 of the mat bar 22 help to guide the angled blade 32. Either blade when cutting the picture mat M will extend into a cutting groove 13.

FIG. 6 is a frontal view of the mat guide mount 40. A bolt 46 extends through the mat guide 42 into the slot 44 to engage with the large nut 48. The bolt 46 has a large knurled head which makes it quickly and easily detachable by hand.

Figure 7:
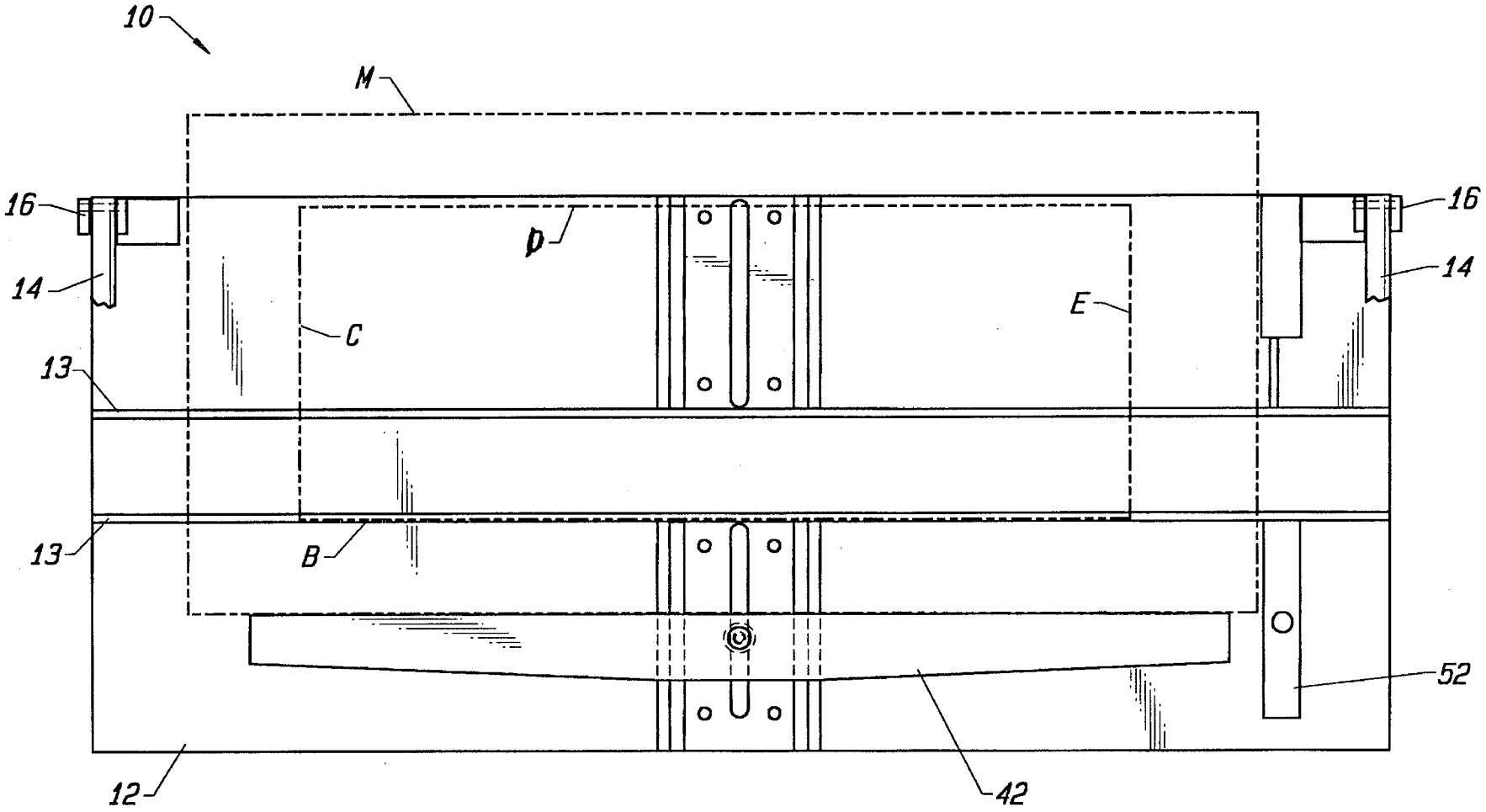
FIG. 7 is a top view of the mat cutter of FIG. 2 showing the placement of a picture mat for conventional cutting.

FIG. 7 shows a picture mat M to be cut placed on the reversible mat cutter 10 of FIGS. 3 through 6. The mat M is placed face down such that the side to be viewed in a picture frame is face down toward the base 12. The clamp frame 14 (not shown) is in its raised position, thus moving the guide assembly 20 (not shown), and cutter head 30 (not shown) off of the base 12 which allows easy placement of the picture mat M on the base. In this embodiment the picture mat M is shown pressed up against the mat guide 42 and the squaring arm 52. The mat guide 42 helps to align the edge of the mat substantially parallel with the cutting grooves 13 and also adjusts the distance of the edge of the mat from the cutting grooves. The squaring arm 52 helps to keep the mat from moving in a direction substantially parallel to the cutting grooves 13.

Once the clamp frame 14 (not shown) is lowered into the cutting position, the picture mat can be cut. The clamp frame 14 will hold the picture mat M firmly to the base 12. Mat M is placed such that when cut, the cutter head 30 (not shown) will cut along edge B of mat M. Once cut, mat M is removed, rotated 90 degrees counter-clockwise and reinserted on base 12 up against the mat guide 42. Mat guide 42 can also be adjusted to cut a wider or narrower border. In this position, the cutter head 30 will cut along edge C of mat M. Subsequently, mat M is removed, rotated, reinserted and cut twice more in order to cut along edges D and E. In this manner, an opening defined by edges B, C, D, E is cut in mat M.

Figure 8:
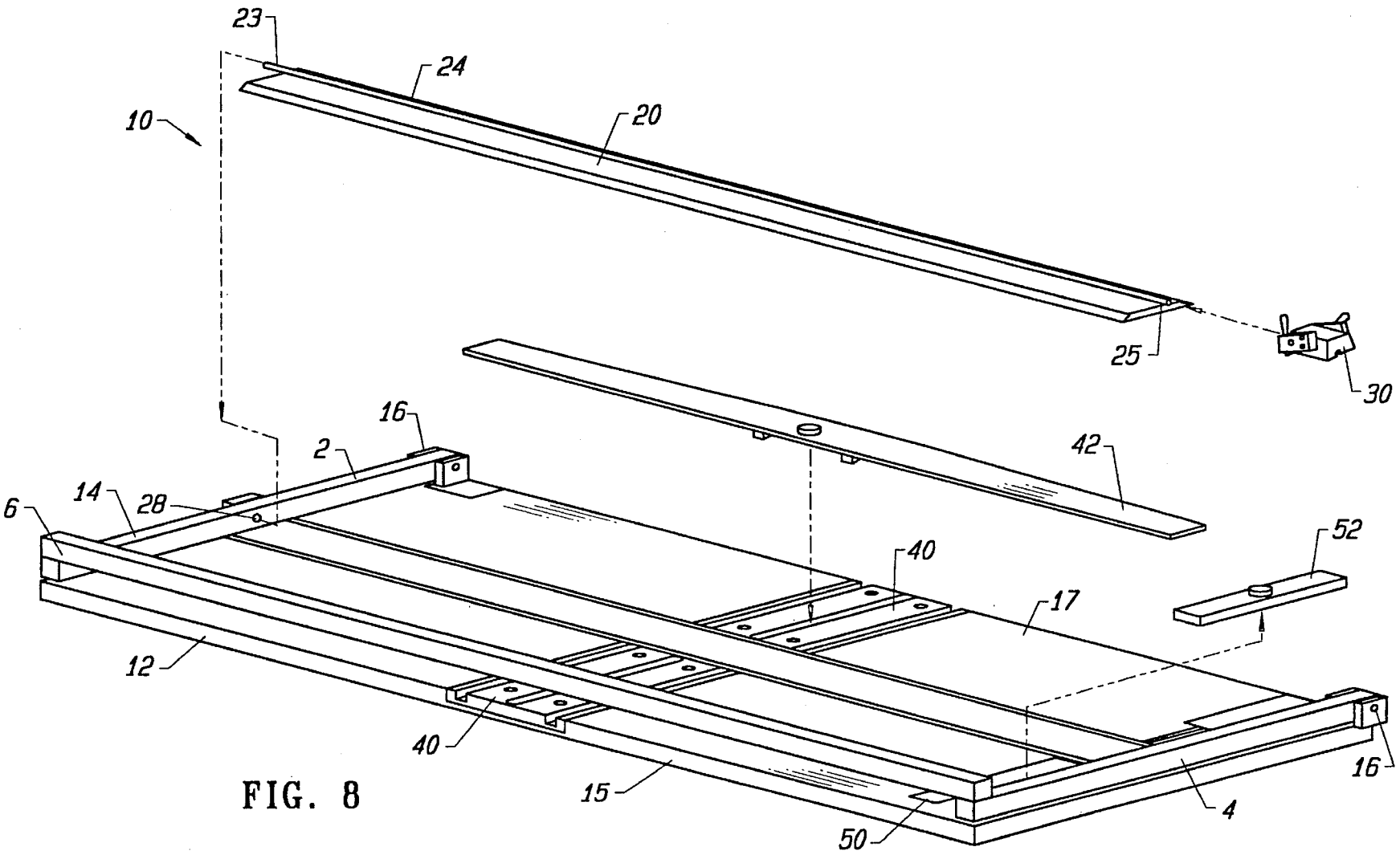
FIG. 8 is a perspective exploded view of the mat cutter of FIG. 2 showing how the mat cutter may be reversed.

FIG. 8 well illustrates a novel feature of the described embodiment whereby the cutter head 30 is reversible as well as the mat guide 42 to allow cutting on a reverse side of the guide assembly 20 in order to accommodate oversized picture mats. Firstly, the guide assembly 20 and specifically the cutter head guide rod 24 are pressed in the direction of arm 2 of the clamp frame 14. End 23 of the cutter head guide rod 24 is pressed into the hole 28 in arm 2 in order to compress the spring 29. End 25 of the cutter head guide rod 24 releases from the hole 28 in arm 4 and the guide assembly 20 is free of the clamp frame 14. Next, the cutter head 30 is slid off of the cutter head guide rod 24 and is reversed. FIG. 8 shows the reversed cutter head 30 being slid back onto the cutter head guide rod 24. Once the reversed cutter head 30 is reattached, end 23 of the cutter head guide rod 24 can be pressed back into hole 28 in the arm 2 to compress the spring 29. End 25 of the cutter head guide rod 24 can then be reinserted into hole 28 of the arm 4 in order to secure the guide assembly 20 to the clamp frame 14.

In another embodiment of the present invention, the cutter head 30 could be detachable from the cutter head guide rod without having to remove the guide assembly 20 from the clamp frame 14. One such cutter head would snap open to allow its removal from the cutter head guide rod 24, would be reversed, and then snapped back onto the cutter head guide rod 24.

FIG. 8 also shows that the mat guide 42 has been removed from side 15 of the base and can be mounted on side 17 of the base. Also, squaring arm 52 has been removed from side 15 of the base. In this manner, side 15 of the base becomes a flat surface and an oversized picture mat can lie flat. Furthermore, the present invention is designed so that the distance from the guide assembly 20 to the pivots 16 is larger than the distance provided in standard mat cutters. This larger distance provides that a large border can be cut on oversized picture mats. By way of example, standard mat cutters generally position the hinges about four inches from the mat bar. In contrast, I have found larger spacing to work well, as for example a spacing of seven inches.

Figure 9:
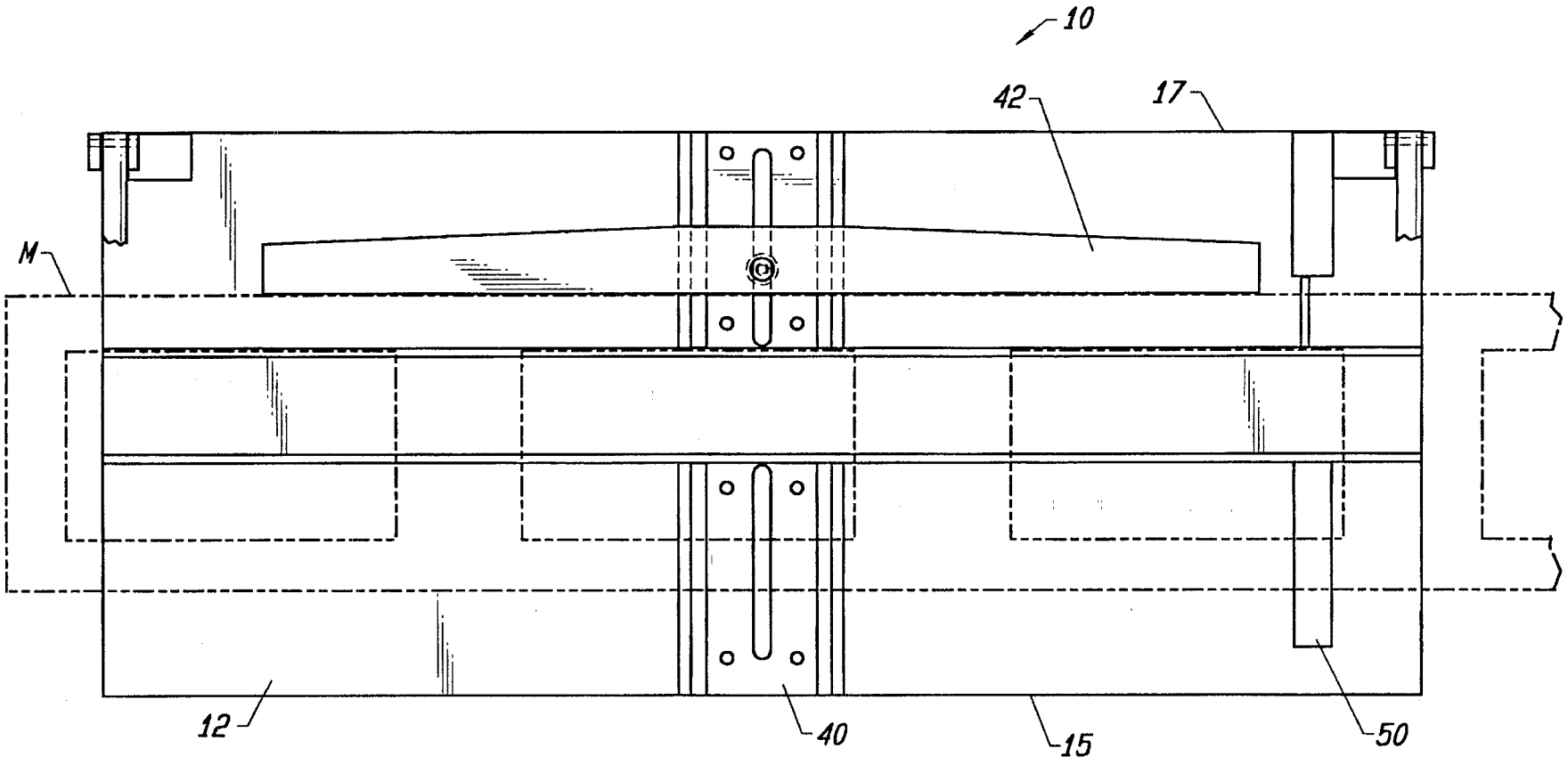
FIG. 9 is a top view of the mat cutter after the mat cutter has been reversed showing the placement of an oversized picture mat.

FIG. 9 shows how the reversible mat cutter reversed as in FIG. 8 can accommodate an oversized picture mat. The mat guide 42 and the squaring arm 52 have been removed from side 15 of the base, allowing an oversized picture mat M to lie flat on the base and have beveled or straight openings cut in its interior. The picture mat M will be pressed up against the mat guide 42, and the reversed cutter head 30 will cut a beveled edge in edge D of the picture mat. In another embodiment of the present invention, an oversized picture mat can be cut in this fashion without the use of the mat guide 42.

Although only a few embodiments of the present invention have been described in detail, it should be understood that the present invention may be embodied in many other specific forms without departing from the spirit or scope of the invention. Particularly, the cutter head may be removed from the guide rod by another means instead of by sliding if off of one end. The cutter head may snap off of the guide rod, or perhaps the cutter head splits in half allowing it to be removed. The cutter head itself does not necessarily have to have one angled blade and one straight blade, it could have only one blade, or could have two angled blades or two straight blades. The cutter head guide rod does not need to be circular in cross-section; it could be of another geometry. Also, the mat bar may have one edge which is not tapered but is straight. Additionally, the mat guide and squaring arms, which are easily removable from the base, could themselves be recessed into the base when not in use, thus providing a flush surface. The clamp frame may be attached to the base by conventional hinges, or by another method which allows the clamp frame to swing up and down.

Therefore, the present examples are to be considered as illustrative and not restrictive, and the invention is not to be limited to the details given herein, but may be modified within the scope of the appended claims.

I claim:

1. A mat cutter for cutting picture mats, the mat cutter comprising:

(a) a base for supporting a picture mat to be cut, the base having a longitudinal direction and a latitudinal direction, the latitudinal direction being substantially perpendicular to the longitudinal direction;

(b) a clamp frame pivotally attached to the base, the clamp frame being moveable between a cutting position suitable for cutting and a raised position;

(c) a flat bottomed mat bar carried by the clamp frame, the mat bar arranged to press a picture mat being cut toward the base, the mat bar further having two latitudinally extending tapered edges;

(d) a cutter head guide rod mounted on a top surface of the mat bar, the cutter head guide rod having a first end that is coupled to the clamp frame in a manner that permits a quick release of the first end of the cutter head guide rod from the clamp frame;

(e) a cutter head slidably mounted on the cutter head guide rod, the cutter head having an angled blade positioned on a first side of the mat bar so that a bevel cut can be cut in the picture mat when the clamp frame is in the cutting position by sliding the cutter head along the cutter head guide rod with the angled blade positioned in a cutting angle and the angled blade guided by either of the latitudinally extending tapered edges of the mat bar;

(f) wherein the orientation of the cutter head can be quickly reversed by releasing the first end of the cutter head guide rod, sliding the cutter head off of the first end, reversing the direction of the cutter head, sliding the reversed cutter head back onto the first end of the cutter head guide rod and reconnecting the first end of the cutter head guide rod, whereby with the cutter head reversed, the angled blade is arranged to cut on a second side of the mat bar;

(g) a mat guide for receiving the picture mat;

(h) a pair of mat guide mounts positioned on opposite sides of the mat bar, each mat guide mount being capable of independently supporting the mat guide whereby the mat guide may be secured to the base on either side of the mat bar to facilitate receiving the picture mat to be cut from either side of the mat bar.

2. A mat cutter for cutting picture mats, the mat cutter comprising:

(a) a base for supporting a picture mat to be cut, the base having a longitudinal direction and a latitudinal direction, the latitudinal direction being substantially perpendicular to the longitudinal direction;

(b) a clamp frame pivotally attached to the cutter base, the clamp frame being moveable between a cutting position suitable for cutting and a raised position;

(c) a guide assembly carried by the clamp frame, the guide assembly having a first end that is coupled to the clamp frame in a manner that permits a quick release of the first end of the guide assembly from the clamp frame;

(d) a cutter head slidably mounted on the guide assembly, the cutter head having an angled blade positioned on a first side of the guide assembly so that a bevel cut can be cut in the picture mat when the clamp frame is in the cutting position by sliding the cutter head along the guide assembly with the angled blade positioned in a cutting angle;

(e) a mat guide and a pair of mat guide mounts positioned on opposite sides of the guide assembly, each mat guide mount being capable of independently supporting the mat guide whereby the mat guide may be secured to the base on either side of the guide assembly to facilitate receiving the picture mat to be cut from either side of the guide assembly; and (f) wherein the orientation of the cutter head can be quickly reversed by releasing the first end of the guide assembly, sliding the cutter head off of the first end, reversing the direction of the cutter head, sliding the reversed cutter head back onto the first end of the guide assembly and reconnecting the first end of the guide assembly, whereby with the cutter head reversed, the angled blade is arranged to cut on a second side of the guide assembly.

3. The mat cutter recited in claim 2 wherein the mat guide is attached to either mat guide mount substantially at the center of the mat guide.

4. The mat cutter recited in claim 2 wherein the mat guide mounts are recessed in the base and the distance between the mat guide and the guide assembly is adjustable.

5. The mat cutter recited in claim 2 wherein:

the guide assembly includes a flat bottomed mat bar arranged to press the picture mat being cut toward the base, and a cutter head guide rod mounted on a top surface of the mat bar, the mat bar further having two latitudinally extending tapered edges suitable for guiding the angled blade such that a bevel cut can be made in the picture mat on either side of the mat bar; and the cutter head is slidably mounted on the cutter head guide rod.

6. The mat cutter recited in claim 5 further having a pair of longitudinally extending parallel cutting grooves formed in the base on opposite sides of the mat bar when the clamp frame is lowered to the cutting position, such that as the angled blade cuts through the picture mat, the angled blade extends into one of the cutting grooves.

7. The mat cutter recited in claim 2 wherein the cutter head further includes a vertically oriented blade located on the first side of the guide assembly, the vertically oriented blade being arranged to make a vertical cut in the picture mat.

8. The mat cutter recited in claim 2 further having a squaring arm, the squaring arm mounted on and easily detachable from the base, the squaring arm positioned on the base such that an edge of the squaring arm is substantially perpendicular to the guide assembly whereby the edge of the squaring arm serves to support the picture mat.

9. A mat cutter for cutting an opening in picture mats, the opening having beveled edges, the mat cutter comprising:

(a) a base for supporting a picture mat to be cut, the base having a longitudinal direction and a latitudinal direction, the latitudinal direction being substantially perpendicular to the longitudinal direction;

(b) a clamp frame pivotally attached to the base at a pair of pivot points, the clamp frame being moveable between a cutting position suitable for cutting and a raised position;

(c) a flat bottomed mat bar carried by the clamp frame, the mat bar arranged to press a picture mat being cut toward the base, the mat bar further having two latitudinally extending tapered edges;

(d) a cutter head guide rod mounted on a top surface of the mat bar, the cutter head guide rod having a first end that is coupled to the clamp frame in a manner that permits a quick release of the first end of the cutter head guide rod from the clamp frame;

(e) a cutter head slidably mounted on the cutter head guide rod, the cutter head having an angled blade positioned on a first side of the mat bar so that a bevel cut can be cut in the picture mat when the clamp frame is in the cutting position by sliding the cutter head along the cutter head guide rod with the angled blade positioned in a cutting angle and the angled blade guided by either of the latitudinally extending tapered edges of the mat bar;

(f) wherein the orientation of the cutter head can be quickly and easily reversed by hand without the use of tools by releasing the first end of the cutter head guide rod, sliding the cutter head off of the first end, reversing the direction of the cutter head, sliding the reversed cutter head back onto the first end of the cutter head guide rod and reconnecting the first end of the cutter head guide rod, whereby with the cutter head reversed, the angled blade is arranged to cut on a second side of the mat bar;

(g) a mat guide for receiving the picture mat, the mat guide being quickly and easily removable and attachable by hand without the use of tools;

(h) a pair of mat guide mounts positioned on opposite sides of the mat bar, each mat guide mount being recessed in the base so that a picture mat may be lain flat over a mat guide mount if the mat guide is not attached to one of the mat guide mounts, each mat guide mount being capable of independently supporting the mat guide whereby the mat guide may be secured to the base on either side of the mat bar to facilitate receiving the picture mat to be cut from either side of the mat bar, whereby a picture mat having a length greater than the distance between the pivot points may be placed flat upon the base and a beveled opening may be cut in the picture mat using the angled blade.

10. A mat cutter as recited claim 9 wherein any components mounted on the base on the first side of the guide assembly are either recessed in the base or mounted to the base in a manner that permits their quick release by hand without the use of tools from the base or recess into the base so as to permit the cutting of picture mats having a length that is greater than the longitudinal length of the base.

11. A mat cutter as recited in claim 9 wherein the cutter head further includes a vertically oriented blade located on the first side of the mat bar, the vertically oriented blade being arranged to make a vertical cut in the picture mat.

12. A mat cutter as recited in claim 11 further having a pair of longitudinally extending parallel cutting grooves formed in the base on opposite sides of the mat bar when the clamp frame is lowered to the cutting position, such that as the vertical blade cuts through the picture mat, the vertical blade extends into one of the cutting grooves.

13. A mat cutter as recited in claim 9 further having a squaring arm, the squaring arm mounted on and easily detachable from the base, the squaring arm positioned on the base such that an edge of the squaring arm is substantially perpendicular to the mat bar whereby the edge of the squaring arm serves to support a picture mat.

14. A that cutter as recited in claim 9 wherein with the angled blade arranged on the second side of the mat bar a beveled border of greater than four inches can be cut in an oversized picture mat.

15. A mat cutter as recited in claim 9 wherein the cutter head guide rod is coupled to the clamp frame by means of a spring which holds the cutter head guide rod to the clamp frame and permits the cutter head guide rod to be quickly and easily releasable from the clamp frame.

* * * * *